United States Patent [19]

Swanson

[11] Patent Number: 4,846,394

[45] Date of Patent: Jul. 11, 1989

[54] CONTAINER AND BLANK THEREFOR

[76] Inventor: Dale W. Swanson, 260 El Dorado Blvd. #812, Webster, Tex. 77598

[21] Appl. No.: 124,292

[22] Filed: Nov. 23, 1987

[51] Int. Cl.[4] ..... B65D 3/10

[52] U.S. Cl. ..... 229/4.5; 229/93; 229/162; 229/195

[58] Field of Search ..... 229/4.5, 162, 93, 910, 229/16 R, 6 R, 155, 158, 40, 195, 194, 1.5 B

[56] References Cited

U.S. PATENT DOCUMENTS

| | | | |
|---|---|---|---|
| 265,836 | 10/1882 | Lindner | 229/4.5 |
| 333,643 | 1/1886 | Lewis | 229/158 |
| 448,143 | 3/1891 | Piper | 229/4.5 |
| 1,216,391 | 2/1917 | Allen | 229/4.5 |
| 1,803,239 | 4/1931 | Deane | 229/4.5 |
| 1,996,997 | 4/1935 | Inman | 229/104 |
| 2,061,496 | 11/1936 | Wright | 229/4.5 |
| 3,009,624 | 11/1961 | Knox | 229/194 |
| 3,305,161 | 2/1967 | Offer | 229/93 |
| 3,476,306 | 11/1969 | Eisenberg | 229/40 |
| 3,604,614 | 9/1971 | Sternfeld | 229/40 |
| 3,690,523 | 9/1972 | Link | 229/155 |

FOREIGN PATENT DOCUMENTS

| | | | |
|---|---|---|---|
| 274404 | 7/1951 | Switzerland | 229/195 |
| 123194 | 2/1919 | United Kingdom | 229/4.5 |

*Primary Examiner*—Gary Elkins

[57] ABSTRACT

A container (20) and blank (10) therefor are formed from a single blank of sheet material. The blank is easily folded and locked in shape into a food-receiving tube (20) with a bottom (50) at a point-of-sale for protecting foodstuffs placed therein from bruising or crushing. The foodstuffs in turn are used to help reinforce the container (20).

2 Claims, 1 Drawing Sheet

FIG. 1
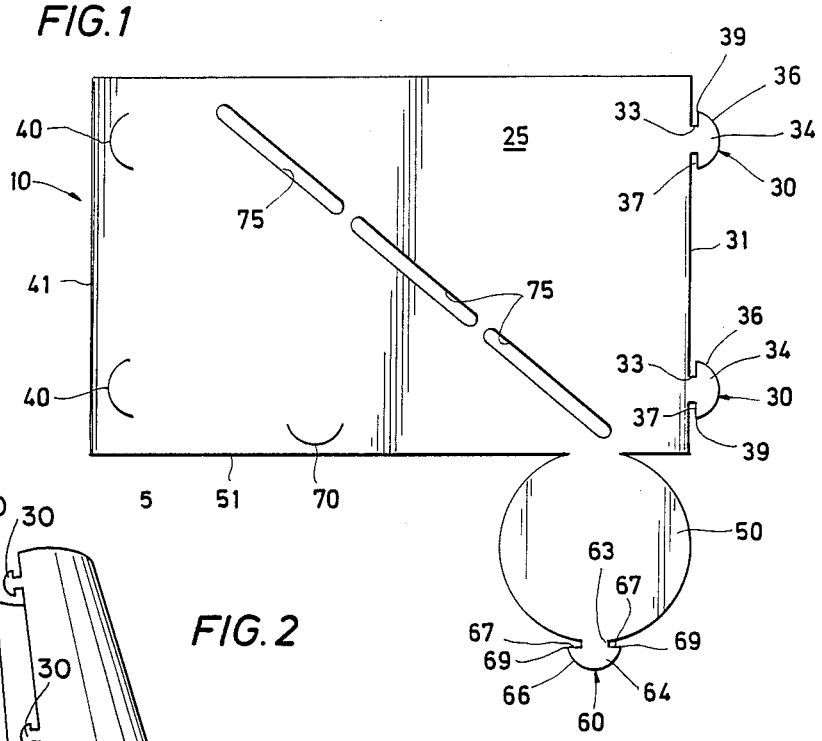
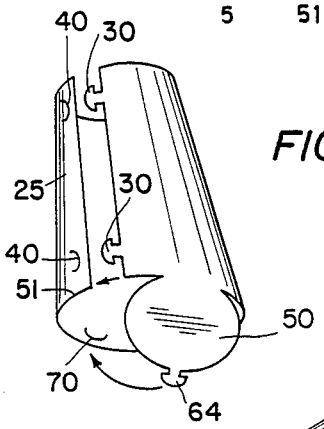
FIG. 2
FIG. 4
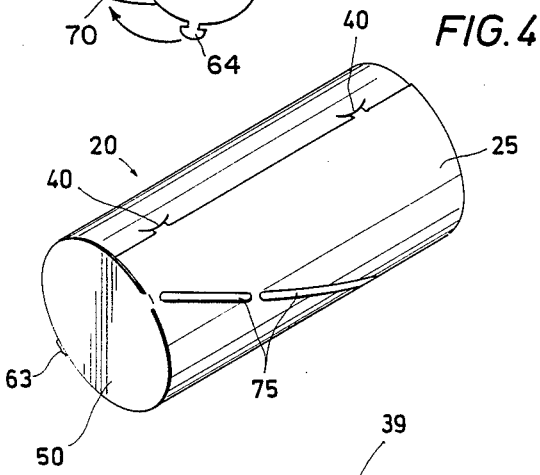
FIG. 5
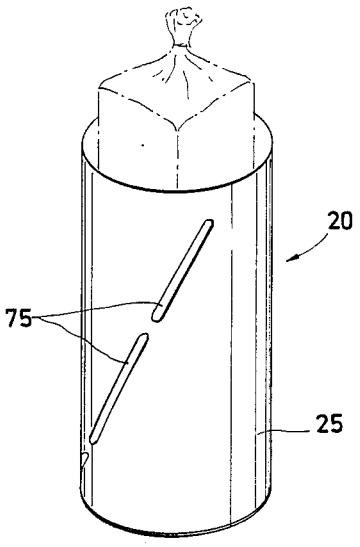
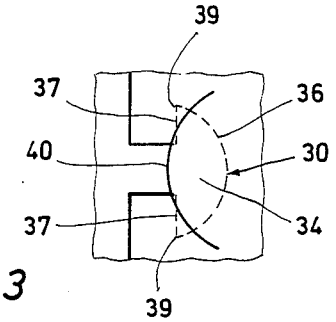
FIG. 3

CONTAINER AND BLANK THEREFOR

BACKGROUND OF THE INVENTION

The present invention relates to containers, blanks for such containers, easy methods for forming containers from such blanks, and means for economically forming such blanks and containers for protecting particularly vulnerable items such as consumer purchased bread, consumer purchased produce, and/or other consumer purchased food products.

In the ordinary, day-to-day purchase of foodstuffs such as a loaf of bread, all too often the food is crushed by the other boxes and cans of food in the grocery bag and/or the grocery cart. A crushed loaf of bread may be accepted as part of the "price" one pays for shopping these days, but a crushed and leaking tomato requires considerably more patience. Yet shoppers reluctantly accept such accidents as inevitable, and consider them an unavoidable result of grocer's efforts to keep costs to a minimum.

Some foodstuffs are protected by rigid or semi-rigid containers. However, rigid and semi-rigid containers cost more than soft bags, and not all purchasers are willing to afford that extra cost unless there is no other practical way to protect the particular food item.

Not surprisingly, the prior art reveals various efforts directed to certain aspects of protecting foodstuffs and other materials by means of specially designed containers formed from sheet stock. For example, U.S. Pat. No. 1,343,726 (Jakobson, issued June 15, 1920) discloses a paper cylindrical container, and a blank therefor, having an integral bottom closure member. The cylinder is held in assembled position by a single, protracted locking tongue and slit. A rounded slot is illustrated, which supports the bottom member having an upwardly facing semi-circular cut opposite the attaching fold line. The bottom member is connected to the main body by a long connecting piece which must be folded and pushed inside the container in order for the edge of the bottom member to rest upon the tab formed by pushing the semi-circular cut inward. Therefore, the outsized dimensions required by the long connecting piece are inappropriate to and not cost effective for protecting a loaf of bread, and the tongue and slit arrangement would not provide adequate support for a container of proper, longer dimensions.

U.S. Pat. No. 1,996,997 (Inman, issued Apr. 9, 1935) employs locking tabs which have a slight gap at the tab bases. These secure integral end portions to the main body of the container, the end portions helping to define the shape of the main body. The main body edges are secured by non-cost effective glue or the like, and the container is otherwise very complicated in its folding and assembly. It is therefore not well suited to point-of-use assembly by the end user. Further, the triangular shape, which uses excessive material, is not best for protecting a square loaf of bread, nor optimally resistant to point pressures applied to one of the sides.

U.S. Pat. No. 2,022,601 (McDonald, issued Nov. 26, 1935) shows a liner for produce baskets to prevent damage from contact with the sides of the basket. The liner, which forms into a frusto-conical shape and has no bottom, shows various tab locking arrangements. The tabs illustrated in FIGS. 1, 2, and 3, which have flaps facing in one direction only and one internal slot and one slot from the bottom edge of the blank, would have a tendency to become undone unless the liner is supported from the outside by a basket or the like. The tabs illustrated in FIGS. 11, 12, and 13 have a slight clearance or spacing from the body of the blank, but are received in straight slots which give them a tendency to slip out. The tabs illustrated in FIGS. 4 through 10 are complicated and not well suited to point-of-use assembly by the user. In addition to lacking a bottom, the liner's frusto-conical shape hardly follows that of a loaf of bread, and would be very wasteful of materials and of space within a grocery bag.

In U.S. Pat. No. 2,140,932 (Avery, issued Dec. 20, 1938), FIGS. 1, 2, and 3 disclose frusto-conical pots or containers made of leather fiber and having an integral, self-supporting bottom. Being preformed, however, they lack cost effectiveness for the uses envisioned herein, and would occupy too much room when stacked near the point of sale. As with McDonald '601 (above), the frusto-conical shape does not follow that of a loaf of bread, and would be very wasteful of materials and of space within a grocery bag. In addition, one protracted tab and slot along most of the leading edges of a long tube would have a tendency to bow outward causing the tab to slip loose from the slot.

U.S. Pat. No. 2,670,129 (Baxter et al., issued Feb. 23, 1954) shows a preformed and non-cost effective shipping tube with an integral end closure, not a user-assembled container formed easily from a flat blank that can be conveniently stacked for use.

U.S. Pat. No. 3,146,111 (Enoch, issued Aug. 25, 1964) employs a stiffening band of paper which is heat sealed to the sides of a bread wrapper. The band or web of material, which can have printing applied to it, does not provide sufficient protection for a loaf of bread.

U.S. Pat. No. 3,305,161 (Offer, issued Feb. 21, 1967) shows a tubular shell secured by tabs with spaced bases which pass through slits having slightly angled ends. The contents of the shell are visible through the perforations therein. However, the tube which is formed lacks a bottom; the tabs have rounded ends which could disengage more easily than might be desired; and there is no mention of the container being reinforced by its own contents to improve flexibility and economy in the fabrication of the container and blank themselves. In addition, the perforations in alternating straight lines weaken the tubular shell.

U.S. Pat. No. 3,330,671 (Stewart, issued July 11, 1967) has a slightly curved slots and forms a container box which is printed upon. However, it is clearly a complicated design which would not be convenient to fold into shape at the point of sale. Also, the flat sides would provide scant support against externally applied pressures, and gluing the flaps together is not cost effective.

U.S. Pat. No. 4,266,668 (Paek, issued May 12, 1981) shows a telescoping dispenser, for various produce items, which appears not only complicated in its manufacture, but rather expensive as well.

U.S. Pat. No. D-227,977 (Bish, issued July 31, 1973) appears to provide a rigid protector for bread loaves. This device is evidently formed or formable from a single, die-cut, double folded sheet of material, and is designed for stacking bread on a store shelf, not for protecting it in a grocery cart or grocery bag.

U.S. Pat. No. D-228,882 (Bish, issued Oct. 30, 1973) shows something which is also designed for stacking bread on a store shelf with some protection, and can be formed from a single sheet of material.

Thus, although some concepts for a bread protecting container appear in the prior art, and some concepts for a tubular container formed from a single sheet and having an integral end also appear in the prior art (most of which is either inconvenient or inefficient and/or is not cost effective in its manufacture and sale), the prior art still fails to teach or even suggest a single embodiment encompassing altogether therein those features which will meet the various needs enumerated and discussed above.

A need therefore remains for an economical, convenient, and efficient way to afford each shopper the individual option of protecting selected food items, such as bread and produce, with a minimum of expense and overhead for both the shopper and the food merchant.

SUMMARY OF THE INVENTION

Briefly, the present invention meets the above needs and purposes with a new and improved food container and blank therefor which can be stored in knocked-down fashion in a minimum of space at various dispensing stations located conveniently near places where vulnerable foodstuffs are located for sale in a grocery store. The pre-cut blank is then easily and quickly formed into a container by the customer for use on the spot. By storing the containers unassembled, a minimum of valuable space in the store is required. Yet due to the careful design of the invention, each container can be easily, effortlessly, and reliably assembled by the user in just seconds. And due to the economical design, the containers can be made available at almost no cost to the user, or be provided to the user by the grocer as a cost-free service. Those customers, therefore, who wish to afford extra protection for their food purchases can do so with effectively no additional economic burden because the cost of the damaged, unusable portions of their food purchases far outweighs the cost of that protection.

More particularly, the invention consists of a unitary sheet which is cut and scored so that it can be formed into a self-locking tube having an integral closure at one end. For maximum economy, maximum ease of assembly, and for providing the necessary flexibility for forming the container into the desired shape without creasing in the wrong places, the material of the container is deliberately chosen to be softer and yet not strong enough to provide the requisite protection and support by itself for the intended foodstuffs. Instead, the design of the invention provides for and considers the contents of the tube to cooperate with and support the tube such that the tube, in consonance with its contents, protects those contents from being bruised or crushed from the outside. In practice, this is accomplished because the tube distributes, and thus "blunts", point contacts and localized pressures, while the contents of the container absorbs soft distributed forces and helps support and reinforce the container.

As indicated earlier, in the preferred embodiment the precut sheets are provided flat, in a stack, at the point of use, and the user then forms and assembles them as needed. To this end, the dimensions and configuration of the tabs and slots have been carefully designed and proportioned to afford easy assembly and reliable security once assembled. The contents of the tube are thus protected in the shopping cart, in the grocery bag, and in the freezer at home.

An additional and useful feature of the invention is a slot around the side, preferably spiraled to prevent creasing at the ends, to allow the contents of the tube to be verified when produce, etc., is contained therein. Another feature is the option of including either advertising copy or in-store coupons on the container.

In a preferred embodiment, therefore, the invention provides both a blank for forming a food container, and the container itself formed therefrom. Such a container includes a tubular portion formed from a substantially rectangular single main sheet of semi-rigid material, shaped into a tube, and a plurality of tab members formed from such semi-rigid material and attached to the main sheet substantially along a first edge thereof. The tab members each include a neck attached to the main sheet along the first edge thereof and a substantially semi-circular tab head having a curved edge and a substantially straight edge. Each tab head is attached on its straight edge to the neck opposite the first sheet edge, and the junction formed by the rounded edge of the head and the ends of the straight edge of the head are each substantially pointed. A plurality of rounded slots is formed in the main sheet along and inside a second edge thereof substantially opposite the first edge. Each such slot self-lockingly receives a corresponding one of the tab members therethrough for holding the main sheet in the tubular form, with the ends of each slot being spaced apart equal to or slightly less than the length of the straight edge of the slot's corresponding tab head for ease in inserting and retaining the tabs in the slots, after which, and with pressure exerted by the tube material in trying to return to its original flat condition, the curved slot essentially becomes smaller in relation to the tab head and the tab head is thereby securely retained.

The container also includes a bottom portion formed from a substantially round sheet of such semi-rigid material and attached to the main sheet along a third edge thereof. Associated therewith is a bottom portion tab member formed from such semi-rigid material and attached to the bottom portion substantially opposite the main sheet third edge. The bottom portion tab member includes a neck attached to the bottom portion, a substantially semi-circular tab head having a curved edge and a substantially straight edge and being attached on its straight edge to the neck opposite the bottom portion. The ends formed by the junction of the curved edge of the head and the straight edge of the head are each substantially pointed. Cooperating with these is a bottom portion rounded slot in the main sheet third edge displaced from the midpoint of the rounded slot along the third edge a distance to the midpoint of the bottom portion which is substantially half the circumference of the bottom portion. The bottom portion slot self-lockingly receives the bottom portion tab member therethrough for holding the bottom portion across one end of the tubular portion, the ends of the bottom portion slot being spaced apart equal to or slightly less than the length of the straight edge of the bottom portion's tab head for ease in inserting and retaining the bottom portion tab in the bottom portion slot.

Advantageously, the food container is sized and dimensioned for receiving a predetermined quantity of a predetermined foodstuff for cooperating therewith to substantially protect such foodstuff from being bruised or crushed, while being reinforced by the foodstuff contained therein to help the sheet material retain its tubular shape. Advantageously, the food container is also formed from a single, unitary blank of material, includes a ½ inch wide substantially spiral slot around and through the tubular portion for viewing the contents of the food container, and optionally includes printed information, such as advertising or in-store coupons, on the outside and/or inside of the container.

It is therefore an object of the present invention to provide such a food container and blank therefor in an inexpensive, uncomplicated, durable, versatile, and reliable configuration, inexpensive to manufacture, and readily suited to the widest possible utilization in food retailing establishments, and for storing loaves of bread in freezers in the home.

These and other objects and advantages of the invention will be apparent from the following description, the accompanying drawings, and the appended claims.

BRIEF DESCRIPTION OF THE DRAWINGS

FIG. 1 is a plan view of a blank for a container according to the present invention, including the viewing slots that spiral around the assembled container as illustrated in FIG. 4;

FIG. 2 is a perspective illustration showing assembly of the blank of FIG. 1 into a tubular container;

FIG. 3 is a fragmentary illustration of the locking engagement of the tabs and slots shown in FIGS. 1, 2, and 4;

FIG. 4 is a perspective view of the assembled container, and;

FIG. 5 illustrates insertion of a loaf of bread into the container shown in FIG. 4.

DESCRIPTION OF THE PREFERRED EMBODIMENT

With reference to the drawings, the new and improved container and blank therefor, according to the present invention, will be described. FIG. 1 shows the blank 10 from which the container 20 (FIGS. 4 and 5) is assembled. Blank 10 is a single, unitary blank of material (having an overall size of $20\frac{1}{2}'' \times 18\frac{3}{4}''$), which, in one preferred embodiment, includes a rectangular, $19\frac{5}{8}'' \times 12''$ main sheet 25 of semi-rigid material, 16 thousandths (0.016″) to 21 thousandths (0.021″) of an inch thick, which can be readily shaped into a tube.

A pair of tab members 30, formed from such semi-rigid material, is integral with the main sheet 25 along a first edge 31 thereof, one each centered substantially 2″ from opposite ends of the first sheet edge 31. The tab members 30 each include a $\frac{1}{8}''$ long, 1″ wide neck 33 attached to the main sheet 25 along the first edge 31 thereof, and a substantially semi-circular tab head 34 having a curved edge 36 and a substantially straight edge 37. The straight edge 37 is $1\frac{3}{4}''$ long; the curved edge 36 is curved on a $\frac{7}{8}''$ radius from a point on the edge of and 2″ from the end of the first sheet edge 31; the hed 34 is $\frac{3}{4}''$ high, and the head 34 is attached on its straight edge 37 to the neck 33 opposite the first sheet edge 31. The ends 39 of the straight edge 37 of the head 34 are each substantially pointed.

A pair of slots 40 is cut in main sheet 25 along a second edge 41 of sheet 25 substantially opposite the first edge 31. The slots 40 are centered one each substantially 2″ from opposite ends of the second sheet edge 41, and are curved on a $\frac{7}{8}''$ radius from a point $1\frac{1}{2}''$ inward from edge 41 and 2″ from the end of the second sheet edge 41, with the ends of each slot 40 being 1″ from the second edge 41 and the ends of each slot 40 being spaced apart $1\frac{3}{4}''$. Each slot 40 is thus formed, as particularly shown in FIG. 3, for self-lockingly receiving a corresponding one of the tab members 30 therethrough for retaining the tabs 30 in the slots 40 and for thereby holding the main sheet 25 in a tubular form (FIG. 4).

A 3″ radius bottom portion 50 is formed from a substantially round sheet of the same semi-rigid material, and is integral with the main sheet 25 along a third edge 51 thereof. The center of the circular bottom portion 50 is $2\frac{7}{8}''$ from the third edge 51 (leaving a $\frac{1}{8}''$ deep portion of the circle as part of the main body 25), and 3″ from the projection of the first edge 31.

A bottom portion tab member 60 is formed from the same semi-rigid material, and is integral with the bottom portion 50 substantially opposite the main sheet third edge 51. The bottom portion tab member 60 includes a $\frac{1}{8}''$ long, 1″ wide neck 63 attached to the bottom portion 50, a substantially semi-circular tab head 64 having a curved edge 66 and a substantially straight edge 67. The straight edge 67 is $1\frac{3}{4}''$ long; the curved edge 66 is curved on a $\frac{7}{8}''$ radius from a point on the arc of the circle and the center of the neck; the head 64 is $\frac{3}{4}''$ high; and the head 64 is attached on its straight edge 67 to the neck 63 opposite the bottom portion 50. The ends 69 of the straight edge 67 of the head 64 are each substantially pointed.

A bottom portion rounded slot 70 in the main sheet third edge 51 is centered substantially $9\frac{1}{2}''$ along the third edge 51 from the center of the bottom portion 50 as it overlaps the third edge 51. Slot 70 is curved on a $\frac{7}{8}''$ radius from a point $1\frac{1}{8}''$ inward from the third edge 51 and substantially $9\frac{1}{2}''$ along the third edge 51 from the center of the bottom portion 50 where it overlaps the edge; the ends of slot 70 are 11/16″ from the third edge 51; the ends of slot 70 are spaced apart $1\frac{3}{4}''$ or slightly less; and the bottom portion slot 70 is thus formed for self-lockingly receiving the bottom portion tab member 60 therethrough for retaining the bottom portion tab 60 in the bottom portion slot 70.

The blank 10 will thus be seen to be sized and dimensioned for forming a tubular food container 20 for receiving, for example, a loaf of bread, and for cooperating therewith to substantially protect the bread from being bruised or crushed. The dimensions are particularly selected such that the container 20 is actually reinforced by the bread when contained therein, to help the sheet material of the container retain its shape. This will be readily understood when it is realized that the sheet material distributes externally applied forces over a large area internally, thus protecting the container's contents from localized damage, while at the same time receiving support and reinforcement from the very same internal contents. By this means a suitably flexible, inexpensive, and lightweight sheet material may be selected, which is formed easily into the container 20 without unwanted creasing or stiffness. In the preferred embodiment, paper board or plastic with a thickness of from 16 thousandths of an inch (0.016″) to 21 thousandths of an inch (0.021″) has proven satisfactory. Any less thickness will not provide enough support to protect the contents. Any more thickness will crease and not form a tube.

In addition to the primary features discussed above, the present invention also includes several convenience features. For example, a $\frac{1}{2}$ inch wide, substantially spiral slot 75 may be formed around and through the blank 10 to assist in viewing the contents of the container 20. Also, printed information (not shown) may be provided on one or both sides of the blank, as desired.

As may be seen, therefore, the present invention has numerous advantages. Principal among these are its economy, ease and convenience of use, inexpensive set-up and assembly (since the consumer does it for free), the substantial protection it affords for its contents while being made of inexpensive, relatively insubstantial material, and the security with which it remains assembled after it has been set up. The invention is thus economical, convenient, and efficient, and affords each shopper the option, individually, of protecting selected food items, such as bread and produce, with a minimum of expense and overhead for both the shopper and the food merchant.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A food container formed from a single, unitary blank of material, comprising:

(a) a tubular portion formed from a rectangular, $19\frac{5}{8}'' \times 12''$ main sheet of semi-rigid material shaped into a tube, said material being 16 thousandths to 21 thousandths of an inch thick, (b) a pair of tab members formed from such semi-rigid material and integral with said main sheet substantially along a first edge thereof, one each centered substantially 2" from opposite ends of said first sheet edge, and said tab members each including:

(i) a $\frac{1}{8}''$ long, 1" wide neck attached to said main sheet along said first edge thereof, and (ii) a substantially semi-circular tab head having a curved edge and a substantially straight edge, said straight edge being $1\frac{3}{4}''$ long, said curved edge being curved on a $\frac{7}{8}''$ radius, said head being $\frac{3}{4}''$ high, and said head being attached on its straight edge to said neck opposite said first sheet edge, the ends of said straight edge of said head each being substantially pointed, (c) means forming a pair of slots in said main sheet along a second edge thereof substantially opposite said first edge, said slots being centered one each substantially 2" from opposite ends of said second sheet edge, said slots being curved on a $\frac{7}{8}''$ radius, the ends of each said slot being 1" from said second edge, the ends of each said slot being spaced apart no more than substantially $1\frac{3}{4}''$, and each said slot self-lockingly receiving a corresponding one of said tab members therethrough for retaining said tabs in said slots and for thereby holding said main sheet in said tubular form, (d) a 3" radius bottom portion formed from a substantially round sheet of such semi-rigid material and integral with said main sheet along a third edge thereof, the center of said bottom portion being $2\frac{7}{8}''$ from said third edge and 3" from the projection of said first edge, (e) a bottom portion tab member formed from such semi-rigid material and integral with said bottom portion substantially opposite said main sheet third edge, said bottom portion tab member including:

(i) a $\frac{1}{8}''$ long, 1" wide neck attached to said bottom portion, (ii) a substantially semi-circular tab head having a curved edge and a substantially straight edge, said straight edge being $1\frac{3}{4}''$ long, said curved edge being curved on a $\frac{7}{8}''$ radius, said head being $\frac{3}{4}''$ high, and said head being attached on its straight edge to said neck opposite said bottom portion, the ends of said straight edge of said head each being substantially pointed, and (f) means forming a bottom portion rounded slot in said main sheet third edge centered substantially $9\frac{1}{2}''$ along said third edge from the center of said bottom portion, said slot being curved on a $\frac{7}{8}''$ radius, the ends of said slot being spaced apart no more than substantially $1\frac{3}{4}''$, said bottom portion slot self-lockingly receiving said bottom portion tab member therethrough for retaining said bottom portion tab in said bottom portion slot and for thereby holding said bottom portion across one end of said tubular portion, (g) said food container thereby being sized and dimensioned for receiving a loaf of bread for cooperating therewith to substantially protect the bread from being bruised or crushed, while being reinforced by the bread contained therein to help said sheet material retain its tubular shape, (h) means forming a substantially spiral slot around and through said tubular portion for viewing the contents of said food container, and (i) printed information on said container.

2. A single, unitary blank of material for forming a food container, comprising:

(a) a rectangular, $19\frac{5}{8}'' \times 12''$ main sheet of semi-rigid material which can be shaped into a tube, (b) a pair of tab members formed from such semi-rigid material and integral with said main sheet substantially along a first edge thereof, one each centered substantially 2" from opposite ends of said first sheet edge, and said tab members each including:

(i) a $\frac{1}{8}''$ long, 1" wide neck attached to said main sheet along said first edge thereof, and (ii) a substantially semi-circular tab head having a curved edge and a substantially straight edge, said straight edge being $1\frac{3}{4}''$ long, said curved edge being curved on a $\frac{7}{8}''$ radius, said head being $\frac{3}{4}''$ high, and said head being attached on its straight edge to said neck opposite said first sheet edge, the ends of said straight edge of said head each being substantially pointed, (c) means forming a pair of slots in said main sheet along a second edge thereof substantially opposite said first edge, said slots being centered one each substantially 2" from opposite ends of said second sheet edge, said slots being curved on a $\frac{7}{8}''$ radius, the ends of each said slot being 1" from said second edge, the ends of each said slot being spaced apart no more than substantially $1\frac{3}{4}''$, and each said slot being formed for self-lockingly receiving a corresponding one of said tab members therethrough for retaining said tabs in said slots and for thereby holding said main sheet in a tubular form, (d) a 3" radius bottom portion formed from a substantially round sheet of such semi-rigid material and integral with said main sheet along a third edge thereof, the center of said bottom portion being $2\frac{7}{8}''$ from said third edge and 3" from the projection of said first edge, (e) a bottom portion tab member formed from such semi-rigid material and integral with said bottom portion substantially opposite said main sheet third edge, said bottom portion tab member including:

(i) a $\frac{1}{8}''$ long, 1" wide neck attached to said bottom portion, (ii) a substantially semi-circular tab head having a curved edge and a substantially straight edge, said straight edge being $1\frac{3}{4}''$ long, said curved edge being curved on a $\frac{7}{8}''$ radius, said head being $\frac{3}{4}''$ high, and said head being attached on its straight edge to said neck opposite said bottom portion, the ends of said straight edge of said head each being substantially pointed, and (f) means forming a bottom portion rounded slot in said main sheet third edge centered substantially $9\frac{1}{2}''$ along said third edge from the center of said bottom portion, said slot being curved on a $\frac{7}{8}''$ radius, the ends of said slot being 11/16" from said third edge, the ends of said slot being spaced apart no more than substantially $1\frac{3}{4}''$, said bottom portion slot being formed for self-lockingly receiving said bottom portion tab member therethrough for retaining said bottom portion tab in said bottom portion slot, (g) said blank thereby being sized and dimensioned for forming a tubular food container for receiving a loaf of bread for cooperating therewith to substantially protect the bread from being bruised or crushed, while being reinforced by the bread contained therein to help said sheet material retain its shape, (h) means forming a substantially spiral slot diagonally across and through said blank, and (i) printed information on at least one side of said blank.

* * * * *